US008056941B2

(12) United States Patent
Segev et al.

(10) Patent No.: US 8,056,941 B2
(45) Date of Patent: Nov. 15, 2011

(54) LOCK WITH EMERGENCY UNLOCKING MECHANISM

(75) Inventors: Erez Segev, Nofit (IL); Henk Schaer, Susteren (NL)

(73) Assignee: Homegate Ltd, Nofit (IL)

( * ) Notice: Subject to any disclaimer, the term of this patent is extended or adjusted under 35 U.S.C. 154(b) by 0 days.

(21) Appl. No.: 12/972,435

(22) Filed: Dec. 18, 2010

(65) Prior Publication Data

US 2011/0140460 A1 Jun. 16, 2011

Related U.S. Application Data

(63) Continuation of application No. PCT/IL2009/000614, filed on Jun. 18, 2009.

(51) Int. Cl.
*E05B 65/10* (2006.01)
*E05C 9/12* (2006.01)

(52) U.S. Cl. ..... 292/21; 292/39; 292/51; 292/142; 292/160; 292/172; 292/199; 292/279; 292/280; 70/107

(58) Field of Classification Search ..... 292/21, 292/37, 39, 51, 142, 159, 160, 172, 199, 292/279, 280; 70/107–111
See application file for complete search history.

(56) References Cited

U.S. PATENT DOCUMENTS

| | | | | | |
|---|---|---|---|---|---|
| 1,161,597 | A | * | 11/1915 | Blosick | 292/280 |
| 1,380,117 | A | * | 5/1921 | Solaini | 70/107 |
| 2,017,244 | A | * | 10/1935 | Gudmundsen | 16/200 |
| 2,672,745 | A | * | 3/1954 | Marchetti | 70/101 |
| 3,991,595 | A | * | 11/1976 | Bahry et al. | 70/120 |
| 4,037,440 | A | * | 7/1977 | Shabtai et al. | 70/108 |
| 4,154,070 | A | * | 5/1979 | Bahry et al. | 70/108 |
| 4,227,723 | A | * | 10/1980 | Rosell | 292/34 |
| 4,362,034 | A | * | 12/1982 | Amgar | 70/108 |
| 4,606,203 | A | * | 8/1986 | Esser | 70/107 |
| 4,984,832 | A | * | 1/1991 | Canepa | 292/36 |
| 5,263,749 | A | | 11/1993 | Errani | |
| 5,718,135 | A | | 2/1998 | Bertenshaw et al. | |
| 5,911,763 | A | * | 6/1999 | Quesada | 70/120 |
| 7,255,375 | B2 | * | 8/2007 | Heid et al. | 292/95 |
| 7,856,856 | B2 | * | 12/2010 | Shvartz | 70/107 |
| 2006/0191303 | A1 | | 8/2006 | Shvarts | |
| 2007/0290789 | A1 | | 12/2007 | Segev et al. | |

* cited by examiner

*Primary Examiner* — Carlos Lugo
(74) *Attorney, Agent, or Firm* — Nathan & Associates Patent Agents Ltd.; Menachem Nathan

(57) ABSTRACT

A door locking device for a door cooperating with a door frame includes a cylinder lock, at least one elongated bolt, and an emergency unlocking mechanism. The elongated bolt is adapted to move linearly to engage to and disengage from the door frame. A transmission including an operating wheel translates circular motion of a rotor of the cylinder lock to a linear motion of the elongated bolt. The emergency unlocking mechanism includes a gear arm connected to a handle and adapted to turn the operating wheel when the handle is turned, disengaging the elongated bolt from the door frame.

20 Claims, 11 Drawing Sheets

LOCK WITH EMERGENCY UNLOCKING MECHANISM

CROSS REFERENCE TO RELATED APPLICATIONS

This application is a Continuation application of PCT patent application PCT/IL2009/000614 and claims priority from IL patent application No. 192350, filed Jun. 19, 2008 and IL patent application No. 196328, filed Jan. 1, 2009, all of which are incorporated herein by reference in their entirety.

FIELD OF THE INVENTION

The present invention relates to locks. More specifically, the present invention relates to a lock with an emergency unlocking mechanism.

BACKGROUND OF THE INVENTION

In general, a door is held shut by means of a latch mechanism. The latch mechanism is spring-loaded so that it automatically catches on to a recess in the door jamb when the door is closed. The latch mechanism is released by means of a handle or knob. When the handle is turned, the latch retracts from the recess in the door jamb and allows the door to be opened.

When closed, the door may be described as separating an inner enclosed area from an outer area. When closed, the door is be partially or fully surrounded by straight or curved structural elements making up the various sections of a door frame. The inner side of the door faces the inside area when the door is closed, while the outer side faces the outer area when the door is closed. Perpendicular to both the inner and outer sides of the door are edge surfaces. One edge surface abuts a door jamb when the door is closed. Other edge surfaces of the door may abut other section of a door frame. In general, door handles are provided on both sides of the door so that the door may be opened from either side. The handle on the inner side of the door may be provided with a handle locking mechanism that locks the latch inside the recess in the door jamb. In this case when the handle locking mechanism is locked, the handle on the outer side of the door cannot be used to open the door. However, simply turning the inside handle overrides the locking mechanism and permits quick exit in case of an emergency.

Where additional security against intruders is required, a door will often be provided with a bolt mechanism. In the case of a relatively simple bolt mechanism, the bolts are inserted into recesses in the door jamb or into structures attached to the door jamb. In the case of a higher security bolt mechanism, additional bolts may be inserted into structures in other parts of the doorframe. Generally, a bolt mechanism does not engage automatically upon closing the door. Rather, in order to engage the bolts, a key is inserted into a keyway and turned, or a knob or handle that is separate from the door handle is turned. In order to disengage the bolts, the key or handle is turned in the opposite direction.

An example of such a bolt mechanism is described in U.S. Pat. No. 3,991,595 (Bahry et al.). Bahry et al. describe a preferred embodiment in which a key-operated cylinder lock turns a wheel that extends four bolts by means of curved links. The bolts extend from various edge surfaces of a door.

In an emergency situation, such as a fire inside a building, it is often necessary to exit quickly. Any delay in opening and exiting through the door could result in serious injury or loss of life. Although a latch mechanism is released simply by turning the door handle, disengaging the bolt mechanism is more time consuming and requires closer attention. Should the bolt release mechanism require a key and the key has been removed form the keyway, time may be wasted in locating the key and inserting it into the keyway. Even if the key is already in the keyway, or a handle is provided for opening the bolt, a panicked individual may waste time in finding the correct direction in which to turn the key or handle. In addition, finding the key or handle on the door may be difficult should the room be dark or filled with smoke.

In WO 2006/003661 (Segev et al.) an intelligent lock was described comprising a mechanical element operative to provide two lock position upon a proper actuation, and an electromechanical (EM) trigger separate from and coupled to the mechanical element and operative to control the actuation. When included in an intelligent locking system, the lock is remotely controllable through a monitoring and control unit, operative to relay commands to the EM trigger.

It is an object of the present invention to provide a lock with a bolt mechanism that may be easily and quickly disengaged in the event of an emergency.

It is another object of the present invention to provide a lock with a bolt mechanism and a safety trigger with an emergency override mechanism.

Other objects and advantages of the present invention will become apparent after reading the present specification and reviewing the accompanying drawings.

SUMMARY OF THE INVENTION

There is thus provided, in accordance with some embodiments of the present invention, a door locking device for a door cooperating with a door frame, comprising:

a cylinder lock;

at least one elongated bolt adapted to move linearly to engage to and disengage from the door frame, with a transmission comprising an operating wheel for translating circular motion of a rotor of the cylinder lock to a linear motion of said at least one elongated bolt; and an emergency unlocking mechanism comprising a gear arm connected to a handle and adapted to turn the operating wheel when the handle is turned, disengaging said at least one elongated bolt from the door frame.

Furthermore, in accordance with some embodiments of the present invention, the transmission comprises a curved link linking said at least one elongated bolt linked to the operating wheel.

Furthermore, in accordance with some embodiments of the present invention, the device comprises a latch for engaging with the door frame, wherein the latch is operable by the handle for disengaging the latch from the door frame Furthermore, in accordance with some embodiments of the present invention, the handle is an inside handle, the device further comprising an outside handle operating only the latch.

Furthermore, in accordance with some embodiments of the present invention, the inside-handle and the outside-handle turn coaxially.

Furthermore, in accordance with some embodiments of the present invention, the inside-handle and the outside-handle engage separate plates of a door lock nut.

Furthermore, in accordance with some embodiments of the present invention, the gear arm is adapted to turn the operating wheel after the handle is partially turned.

Furthermore, in accordance with some embodiments of the present invention, the gear arm comprises teeth engaging with corresponding teeth of the operating wheel.

Furthermore, in accordance with some embodiments of the present invention, the corresponding teeth of the operating wheel are located on an auxiliary wheel fixed coaxially to the operating wheel.

Furthermore, in accordance with some embodiments of the present invention, the teeth of the gear arm engage the corresponding teeth of the operating wheel via an intermediary gear wheel, such that rotation of the gear arm causes the operating wheel to rotate in the same direction as the rotation of the gear arm.

Furthermore, in accordance with some embodiments of the present invention, said at least one elongated bolt comprises elongated bolts cooperating with different edges of the door frame.

Furthermore, in accordance with some embodiments of the present invention, at least three elongated bolts of said at least one elongated bolt are cooperating with a jamb of the door frame.

Furthermore, in accordance with some embodiments of the present invention, the device further comprises a separately actuated catch mechanism used to immobilize the operating wheel and that is released when the handle is turned.

Furthermore, in accordance with some embodiments of the present invention, the catch mechanism comprises an electromagnetic actuator.

Furthermore, in accordance with some embodiments of the present invention, the electromagnetic actuator is cooperating with the catch using a cable.

Furthermore, in accordance with some embodiments of the present invention, the catch mechanism is remotely controlled.

Furthermore, in accordance with some embodiments of the present invention, the locking device comprises a MUL-T-LOCK 265 locking mechanism.

Furthermore, in accordance with some embodiments of the present invention, the locking device comprises a Shiryonit Hosen 104/105 locking mechanism.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention. Like components are denoted by like reference numerals.

DETAILED DESCRIPTION OF EMBODIMENTS

According to embodiments of the present invention a lock mechanism may include a bolt mechanism. The lock mechanism may also include a latch mechanism. A spring causes a latch of the latch mechanism to engage a door jamb when the door is closed. The latch is disengaged by turning a door knob or handle from either side of the door. When locked, the bolt mechanism extends elongated bolts that engage recesses or other structures in the door jamb. Bolts may also engage structures in other elements of a doorframe. The terms "door jamb" and "door frame" herein refer to structural elements that support, abut or engage the door, for example the inner surfaces of the opening in the wall in which the door is placed, or a door frame that is attached to the inner surfaces of that opening. The bolts may be engaged or disengaged from either side of the door through the use of a key. Alternatively, a bolt mechanism may be operated by means of a handle or knob from the inside, and by means of a key from the outside. In order to enable quick unlocking of the door in an emergency situation, both the bolts and the latch may be disengaged by turning the inside door handle. Turning the outside door handle only disengages the latch. Therefore, when the bolts are engaged, the door cannot be opened from the outside by means of the door handle alone.

Figure 1:
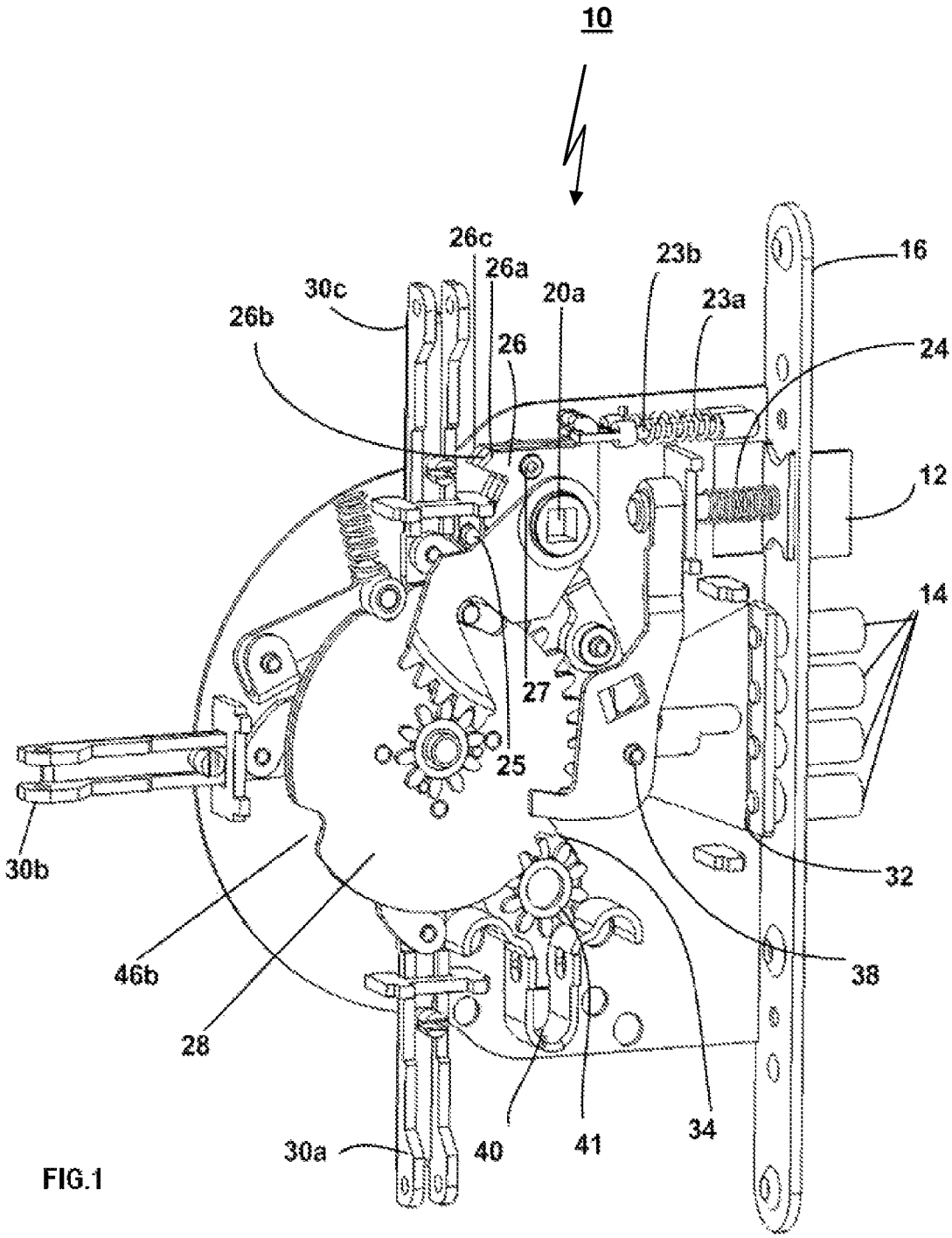
FIG. 1 is a perspective view of a lock mechanism with emergency unlocking capability, according to an embodiment of the present invention, in an engaged and locked state, as viewed from the inside of the door.
Figure 2:
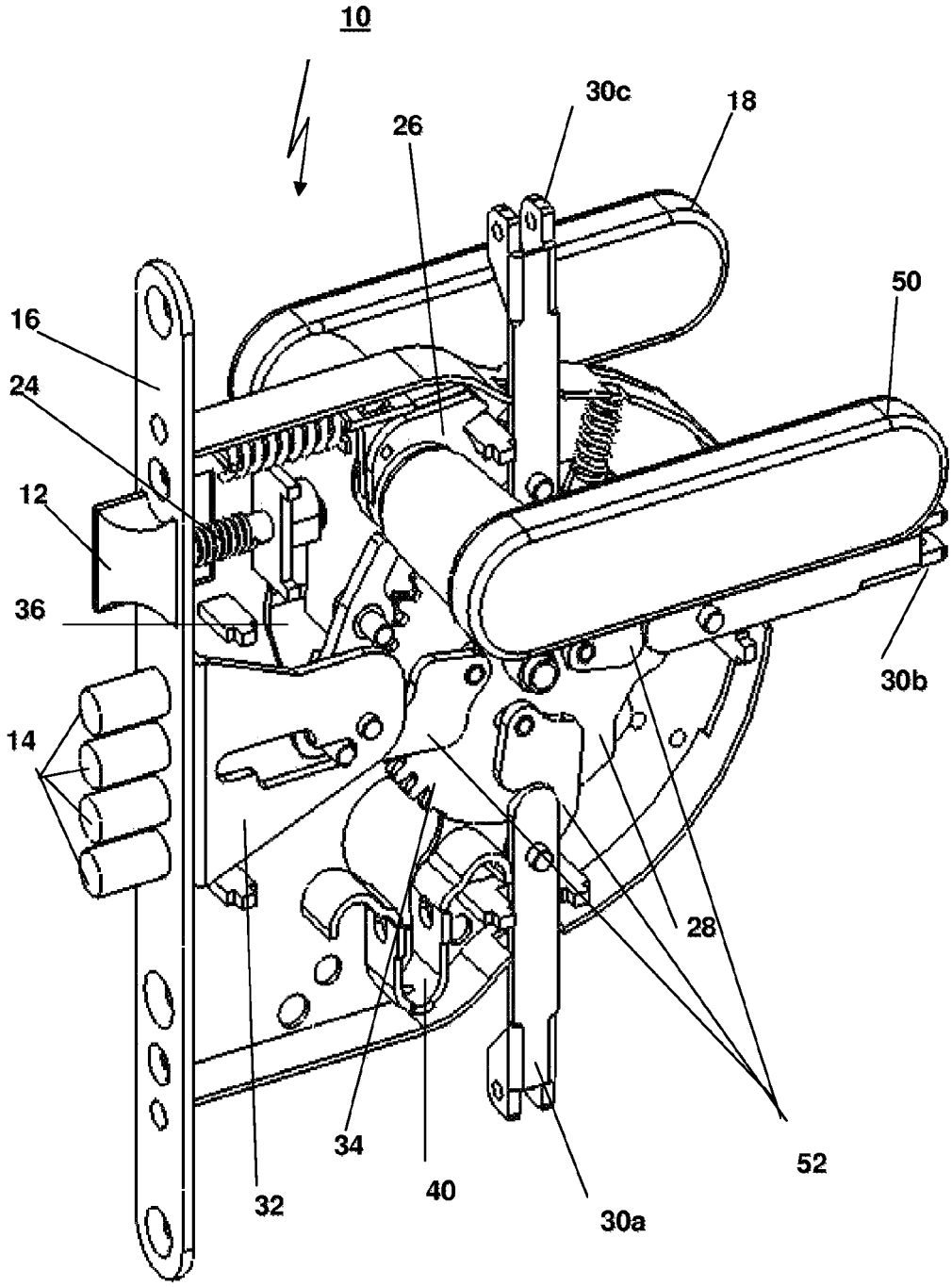
FIG. 2 is a perspective view of the lock mechanism shown in FIG. 1, in an engaged and locked state, as viewed from the outside of the door.

The following discussion refers to FIG. 1 and FIG. 2. FIG. 1 is a perspective view of a lock mechanism with emergency unlocking capability, according to an embodiment of the present invention, in an engaged and locked state, as viewed from the inside of the door. FIG. 2 is a perspective view of the lock mechanism shown in FIG. 1, in an engaged and locked state, as viewed from the outside of the door.

Lock mechanism 10 is mounted within a cavity within a door (not shown). Lock mechanism 10 is mounted such that faceplate 16 is flush with the edge surface of the door that faces the door jamb (not shown) when the door is closed. The spindle of inner door handle 18 is inserted into inner spindle opening 20*a*, which cooperates with lock mechanism 10. The spindle of outer door handle 50 is inserted into an outer spindle opening (not shown), which does not cooperate with lock mechanism 10. Both inner door handle 18 and outer door handle 50 rotate coaxially about the same spindle axis. However, inner door handle 18 and outer door handle 50 are each coupled separately to lock mechanism 10 and not to each other. Therefore, inner door handle 18 or outer door handle 50 have different functions, and each may be turned without turning the other.

Door lock nut 26 includes three separate cooperating plates, inner plate 26*a*, middle plate 26*b*, and outer plate 26*c*. Screw 27 connects inner plate 26*a* to middle plate 26*b* so that they rotate together. As described below, rotation of middle plate 26*b* operates the emergency unlocking mechanism by means of pin 25 on middle plate 26*b*. When middle plate 26*b* rotates, pin 25 presses on gear arm 22, causing gear arm 22 to rotate. Outer plate 26*c* is free to rotate with respect to middle plate 26*b* and inner plate 26*a*. Inner plate 26*a* includes inner spindle opening 20*a* into which the spindle of inner door handle 18 may be inserted. Rotating inner door handle 18 rotates inner plate 26*a* and middle plate 26*b*. Thus, as described below, rotating inner door handle 18 operates the emergency unlocking mechanism. Inner spring 23*a* tends to restore inner plate 26*a*, middle plate 26*b*, and inner door handle 18 to their original positions. Outer plate 26*c* includes an outer spindle opening into which the spindle of outer door handle 50 may be inserted. Rotating outer door handle 50 rotates outer plate 26*c*. Since outer plate 26*c* rotates independently of middle plate 26*b*, rotating outer door handle 50 does not operate the emergency locking mechanism. Outer spring 23*b* tends to restore outer plate 26*c* and outer door handle 50 to their original positions.

Screw 27 may be detached from inner plate 26*a* and middle plate 26*b*, and reinserted so as to connect outer plate 26*c* to middle plate 26*b*. In such a case, the lock is reconfigured so that formerly outer plate 26*c* functions as the inner plate described above. Such reconfiguration may be necessary, for example, in adapting the lock to a door that opens in the opposite direction. Plates 26*a*, 26*b* and 26*c* are mounted coaxially. In an alternative embodiment only the plates which are coupled by screw 27 (plates 26*a* and 26*b* in this figure, or plates 26*b* and 26*c* in an alternative configuration) are coaxially mounted.

The spindles of inner door handle 18 and outer door handle 50 may be collinearly mounted on a single axis in such a manner as to rotate independently about the axis. Alternatively, the spindles of inner door handle 18 and outer door handle 50 may be separate, each separately inserted into a separate spindle opening.

As drawn in FIG. 1 and FIG. 2, lock mechanism 10 is in an engaged locked state. Latch 12, bolts 14, and rod brackets 30*a*-30*c* are all extended. When lock mechanism 10 is put into its locked state while the door is closed, the extended latch 12 and bolts 14 fit into and engage structures in the door jamb. Engaging the structures in the door jamb locks the door and prevents it from being opened. Bolts 14 are mounted on bolt arm 32. Additional bolts in the form of long rods (not shown) extend from rod brackets 30*a*-30*c* for engagement with other parts of the doorframe. When the door is locked, rod brackets 30*a*-30*c* are extended. Extending rod brackets 30*a*-30*c* inserts the attached bolts into corresponding structures in the doorframe (not shown). The additional bolts provide additional security against forced entry through the door. A locking mechanism as described is found, for example, in the MUL-T-LOCK 265 locking mechanism.

Extension or retraction of bolt arm 32 and rod brackets 30*a*-30*c* is governed by operating wheel 28. In the example as shown in FIG. 1, counterclockwise rotation of operating wheel 28 puts lock 10 into its locked state. Clockwise rotation of operating wheel 28 results in an unlocked state. When operating wheel 28 rotates counterclockwise, curved links 52 linearly extend bolt arm 32 and rod brackets 30*a*-30*c*. Extension of bolt arm 32 and rod brackets 30*a*-30*c* causes bolts 14 and the bolts connected to rod brackets 30*a*-30*c* to engage corresponding structures in the doorframe. Engagement of the structures in the doorframe locks the door. The end of spring-loaded arm 42 engages notch 46*a* of operating wheel 28. Engaging notch 46*a* prevents operating wheel 28 from rotating in response to forces applied to bolts 14, or in response to any other forces other than those applied via cylinder lock and handle mechanisms.

As shown in FIG. 1, when operating wheel 28 rotates clockwise, bolt arm 32 and rod brackets 30*a*-30*c* are retracted. Retracting bolt arm 32 and rod brackets 30*a*-30*c* disengages bolts 14 and the bolts attached to rod brackets 30*a*-30*c* from the doorframe. Disengaging bolts 14 and the bolt rods from the doorframe unlocks the door. Clockwise rotation of operating wheel 28 also causes latch arm 36 to pivot counterclockwise about pivot point 38. Counterclockwise pivoting of latch arm 36 pulls latch 12 toward the left. The movement of latch 12 to the left disengages it from the door jamb and allows the door to open.

A cylinder lock with a keyway (not shown) may be mounted in bracket 40. The cylinder lock may be used to rotate operating wheel 28, thus locking or unlocking the door. Inserting a key into the cylinder lock and turning it turns gear 41. The teeth on gear 41 engage teeth 34 on operating wheel 28, causing operating wheel 28 to rotate. Alternatively, the end of the cylinder lock that faces the inside of the door may be provided with a knob. The knob allows rotation of the cylinder lock without the use of a key.

When all bolts are disengaged and the door is unlocked, outer door handle 50 (shown in FIG. 2) inserted into outer spindle opening 20*b* (FIG. 3) may be used to retract the latch and open the door. Pushing down on the end of outer door handle 50 in a causes outer spindle opening 20*b* to rotate in a counterclockwise direction as viewed from outside the door (FIG. 1). Rotating outer spindle opening 20*b* causes door lock nut 26 to rotate in a counterclockwise direction, rotating latch arm 36 in a counterclockwise direction and disengaging latch 12 from the door jamb. When the outer door handle is released, spring 24 causes latch 12 to return to its extended position.

On the other hand, pushing down on the end of outer door handle 50 disengages only the latch from the door jamb. If outer door handle 50 is turned while the bolts engage the doorframe, the engaged bolts lock the door and prevent it from opening. Thus, when the door is been locked, it is not possible to open the door using the outer door handle alone. It is also necessary that a key be inserted into the keyway of the cylinder and turned in order to unlock the door and cause the bolts to disengage.

Figure 3:
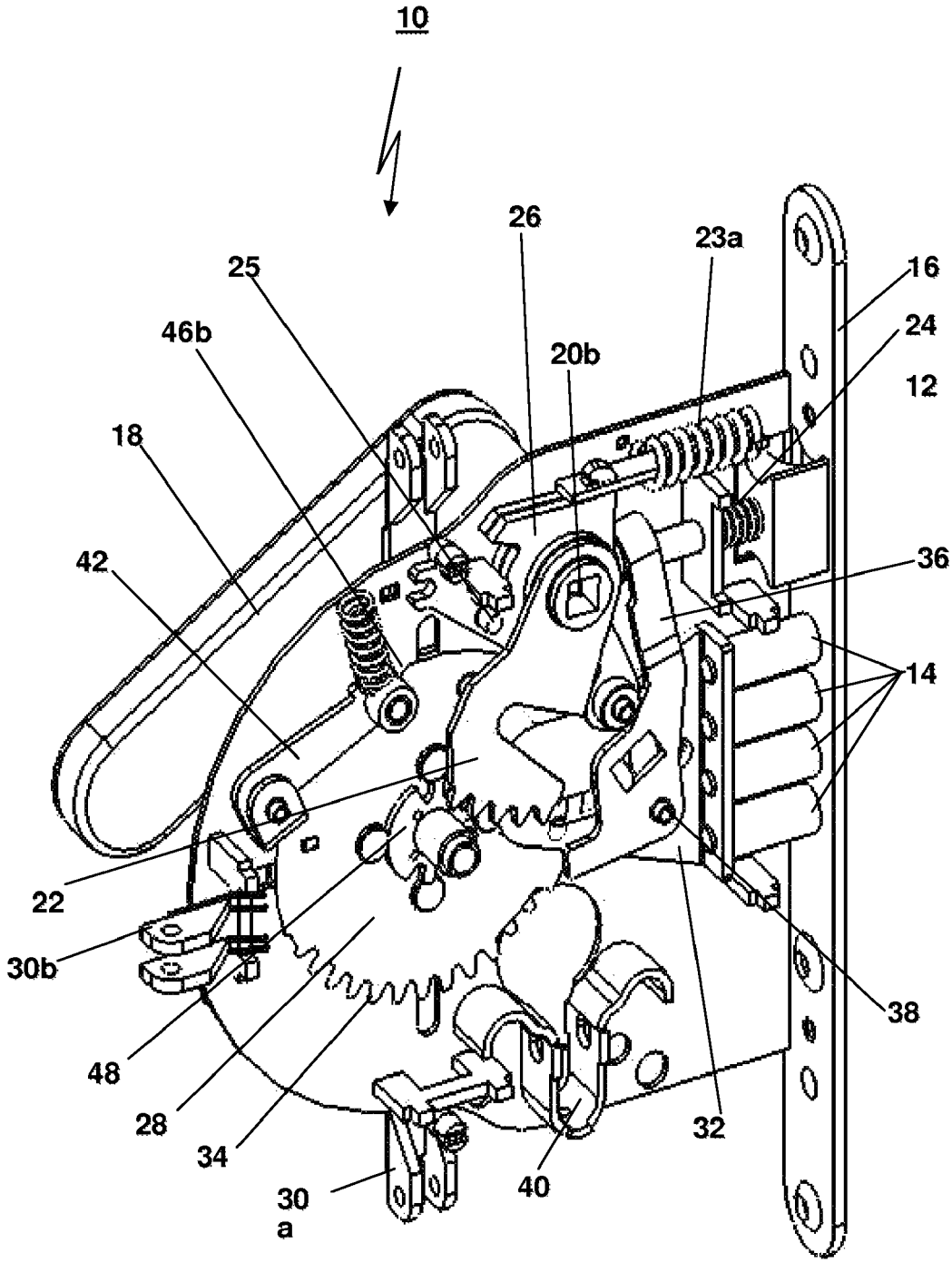
FIG. 3 is a perspective view of the lock mechanism with emergency unlocking capability, according to an embodiment of the present invention, in a disengaged unlocked state, as viewed from the outside of the door.
Figure 4:
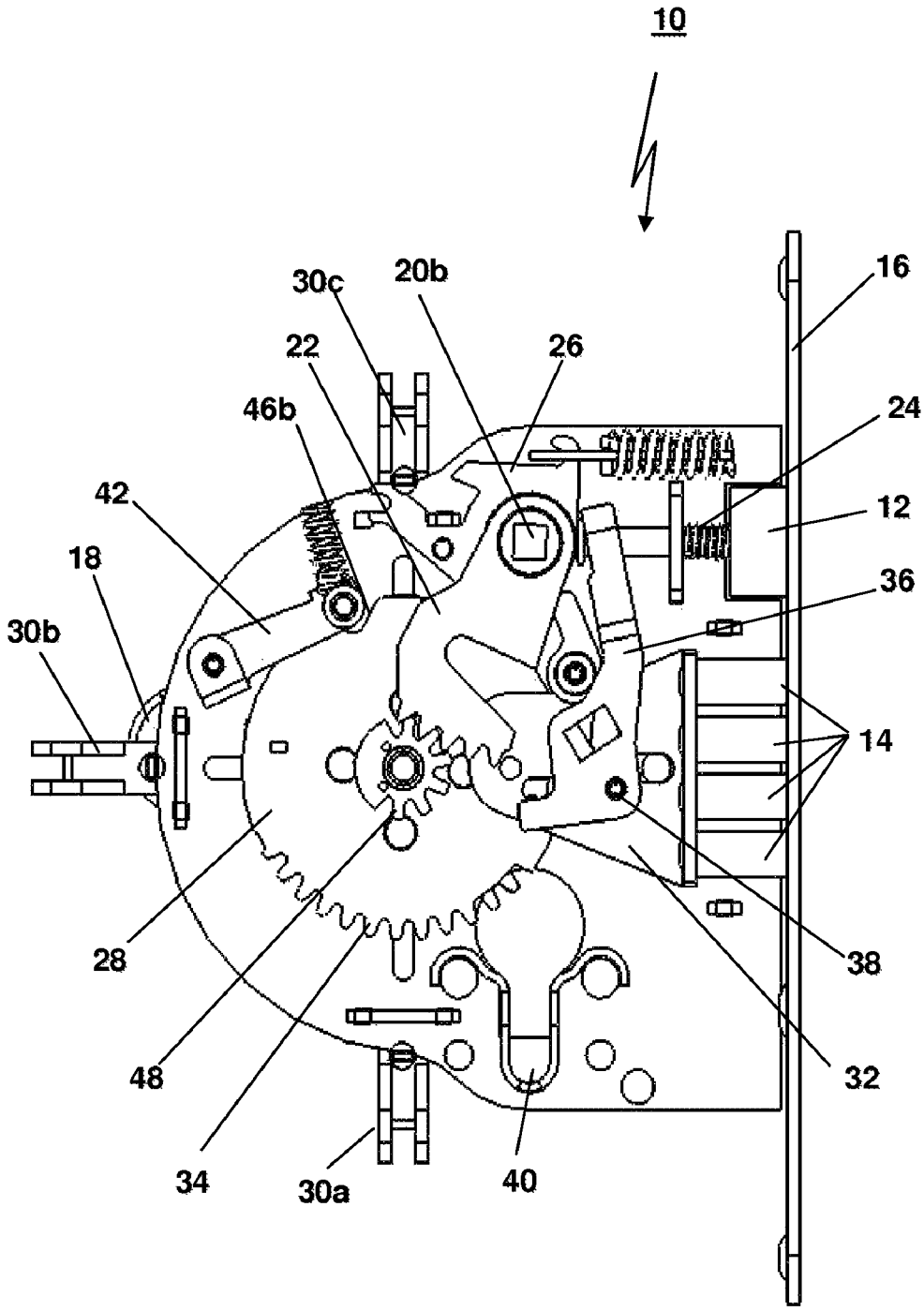
FIG. 4 is a side view of the lock mechanism shown in FIG. 3, in a disengaged unlocked state, as viewed from the outside of the door.
Figure 5:
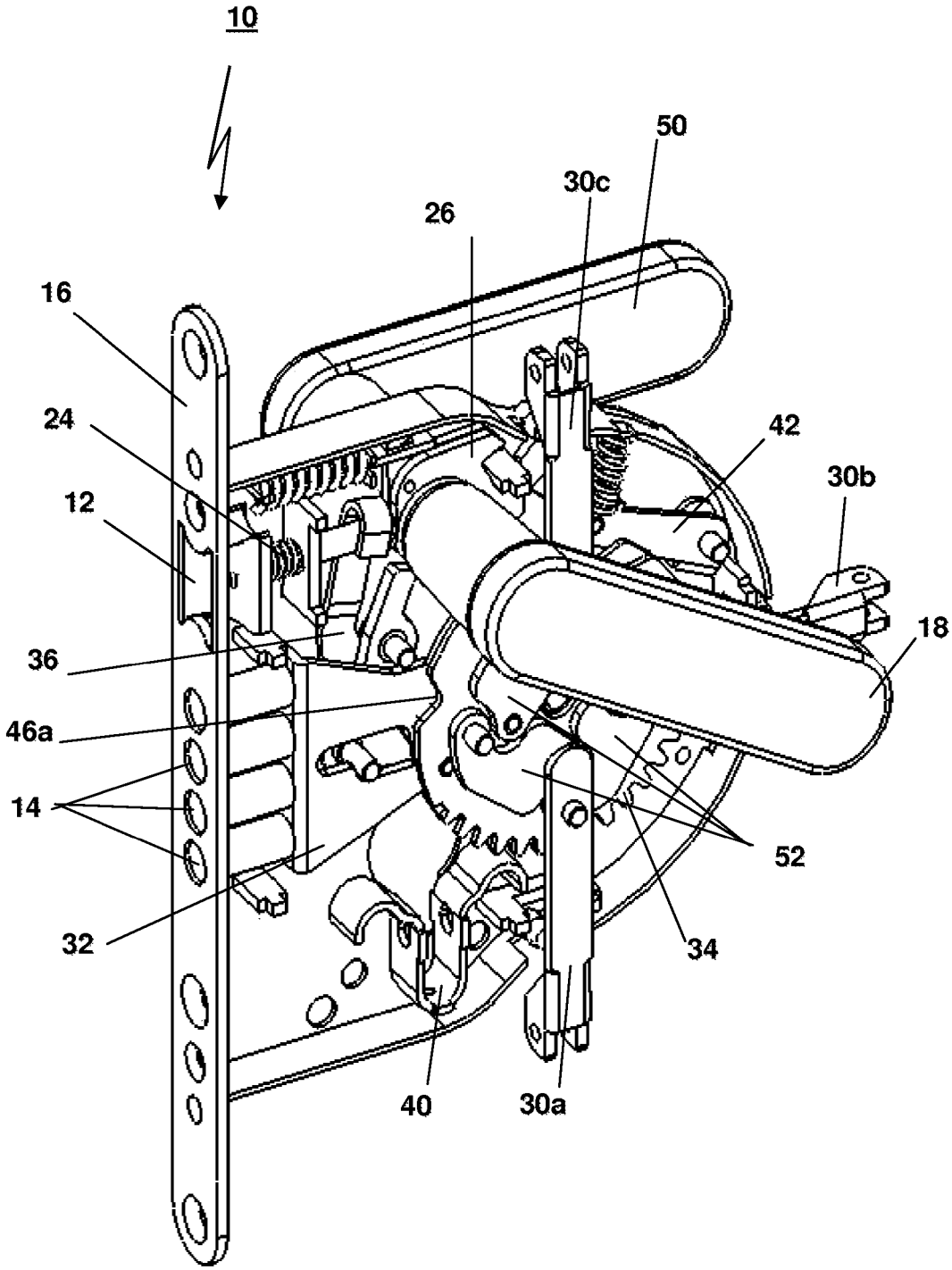
FIG. 5 is a perspective view of the lock mechanism shown in FIG. 3, in a disengaged unlocked state, as viewed from the inside of the door.

We know refer to FIG. 3 through FIG. 5. According to embodiments of the present invention a locking mechanism is provided that enables unlocking and opening the door by turning the inner door handle alone. FIG. 3 is a perspective view of the lock mechanism with emergency unlocking capability, according to an embodiment of the present invention, in a disengaged unlocked state, as viewed from the outside of the door. FIG. 4 is a side view of the lock mechanism shown in FIG. 3, in a disengaged unlocked state, as viewed from the outside of the door. FIG. 5 is a perspective view of the lock mechanism shown in FIG. 3, in a disengaged unlocked state, as viewed from the inside of the door. Note that in FIG. 3-5, the configuration of the lock has been altered so from the configuration shown in FIG. 1-2 for the sake of clarity of the presentation. In FIG. 3-5, the inner and outer sides of the lock are reversed with respect to the lock shown in FIG. 1-2. For example, in FIG. 3 and FIG. 5, the positions relative to other components of inner handle 18 and of outer handle 50 are reversed with respect to their positions in FIG. 2. Also, inner spindle opening in FIG. 1 becomes outer spindle opening 20*b* in FIG. 3 and FIG. 4. This alteration of the configuration may be accomplished by altering the placement of screw 27 (shown in FIG. 1) on door lock nut 26, as described above.

Turning inner door handle 18 causes rotation of components of door lock nut 26, including pin 25. Therefore, turning inner door handle 18 causes pin 25 to press against gear arm 22. Gear arm 22 is mounted so as to rotate coaxially with inner door handle 18. Depressing inner door handle 18 thus causes gear arm 22 to rotate in a counterclockwise direction as viewed from outside the door (FIG. 3 and FIG. 4). Outer spindle opening 20*b* may accommodate the spindle of outer door handle 50. Rotation of outer spindle opening 20*b* does not cause rotation of pin 25. Therefore, rotation of outer door handle 50 does not cause gear arm 22 to rotate. The movement of inner door handle 18 is not coupled to the movement of outer door handle 50 and inner door handle 18 moves independently of outer door handle 50. The teeth of gear arm 22 engage the teeth of auxiliary gear wheel 48 that is affixed coaxially to operating wheel 28. Counterclockwise rotation of gear arm 22, as viewed from outside the door (FIG. 3 and FIG. 4) therefore causes auxiliary gear wheel 48 and the attached operating wheel 28 to rotate in a clockwise direction. As described above, clockwise rotation of operating wheel 28 causes, via a transmission mechanism (not shown), bolt arm 32 and bolt rod brackets 30*a*-30*c* to retract. Retraction of bolt arm 32 and bolt rod brackets 30*a*-30*c* disengages bolts 14 and the bolts attached to rod brackets 30*a*-30*c* (not shown) to disengage from the doorframe. The end of spring-loaded arm 42 of engages notch 46*b* of operating wheel 28. Engaging notch 46*b* prevents operating wheel 28 from rotating from rotating when no intentional force is applied. Unintentional rotation of operating wheel 28 could cause the bolts to engage the doorframe, thus accidentally locking the door. Clockwise rotation of operating wheel 28 also causes latch arm 36 to rotate in a counterclockwise direction, disengaging latch 12 from the door jamb. Thus a single turning motion of inner door handle 18 both unlocks and unlatches the door. Unlocking and unlatching the door allows the door to swing or slide open.

Spring 23*a* restores the position of door lock nut 26, pin 25, and inner door handle 18. However, restoring pin 25 does not restore gear arm 22 to its original position. Therefore, the door remains unlocked until the door is locked until a cylinder mechanism is operated to rotate gear 41, relocking the mechanism.

Alternatively, in embodiments of the present invention, the lock mechanism is configured such that partially turning the inner door handle unlatches the door, while further turning of the inner door handle disengages the bolts. In such a configuration, the shape of gear arm 22 in FIG. 1 is modified so as to engage auxiliary gear wheel 48 only after handle 18 has been partially turned. A mechanism so configured prevents accidental or unintentional unlocking of the door.

Figure 8:
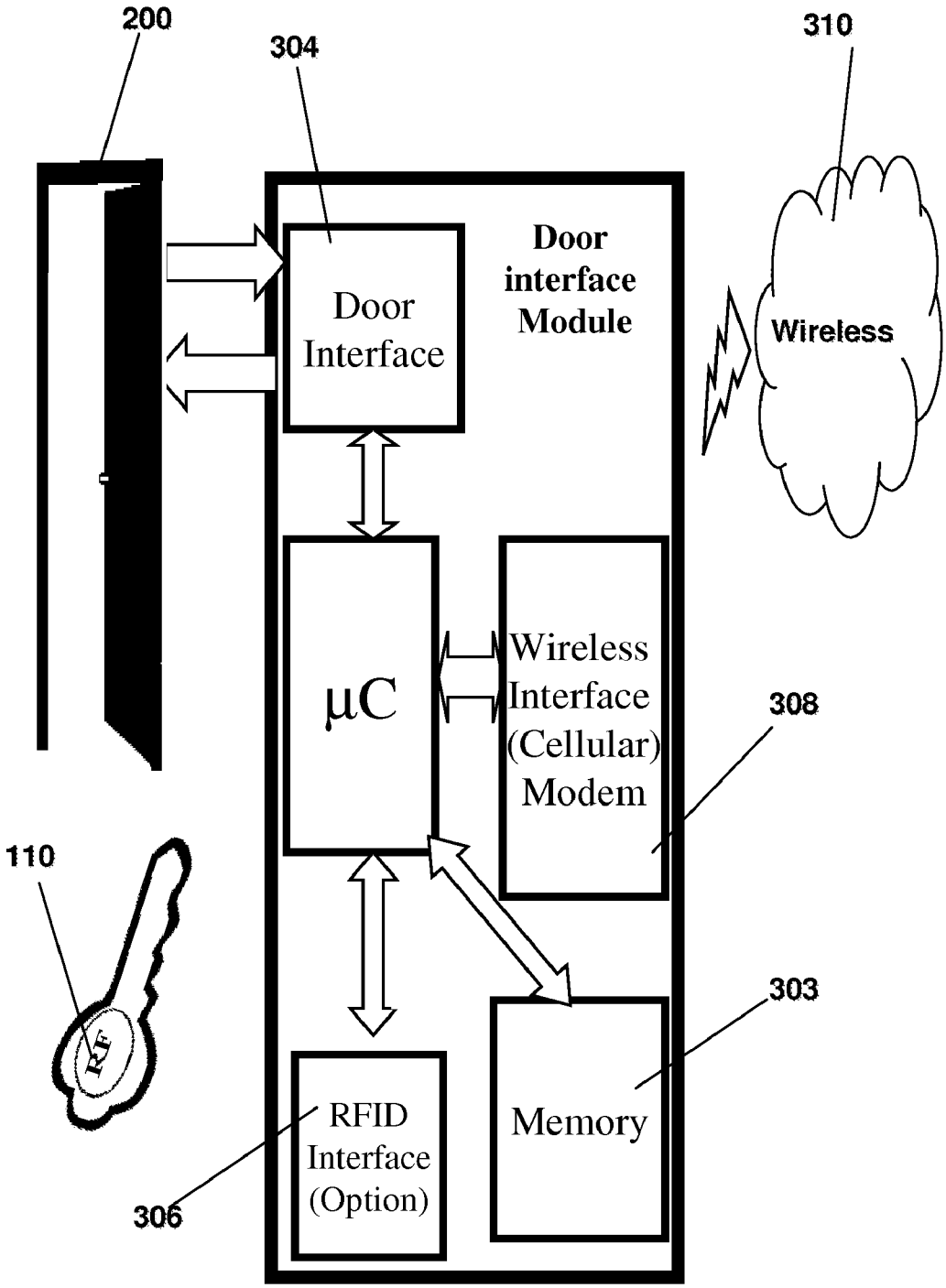
FIG. 8 Prior Art
FIG. 8 is a schematic illustration of the control of a remotely controlled electromagnetic catch mechanism.

In embodiments of the present invention, lock mechanism 10 may be provided with an electromagnetically actuated catch mechanism. The catch mechanism may be remotely controlled. FIG. 8 is a schematic illustration of the control of a remotely controlled electromagnetic catch mechanism. A lock interface module (LIM) 204 is functionally coupled to a lock in door 200 via lock interface 304. Lock interface 304 is controlled by microcontroller 302. Microcontroller 302 communicates with memory 303 where data and programs are stored. In accordance with input from identification interface 306 and wireless interface 308, and in accordance with predefined rules stored in memory 303, microcontroller 302 causes lock interface 304 to lock or unlock the catch mechanism. Identification interface 304 identifies a unique identification device embedded in 110. Wireless interface 308 may receive instructions from remote devices (not shown) via a wireless network 310. In addition, microcontroller 302 may report events such as the door or lock being opened or closed to a remote device via wireless interface 308 and wireless network 310.

Figure 6:
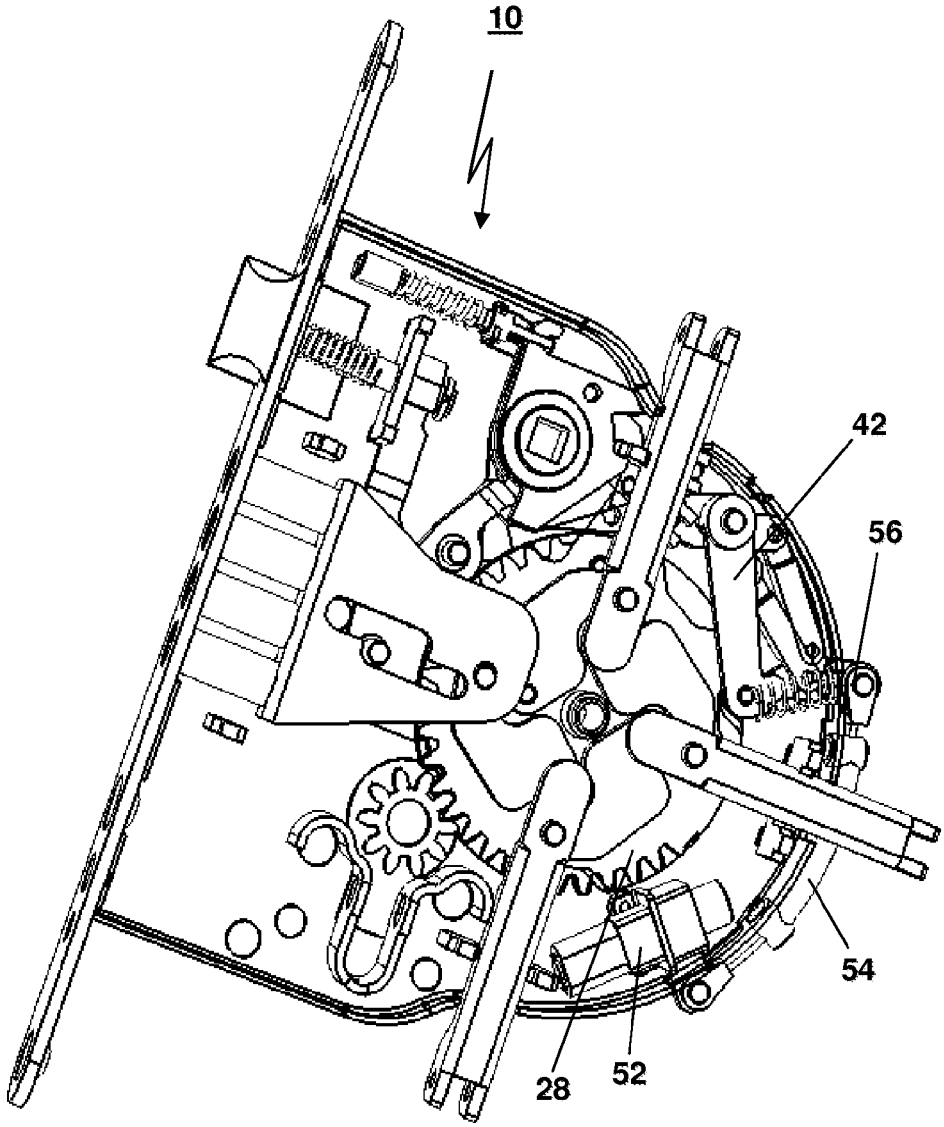
FIG. 6 is a perspective view of a lock mechanism provided with an additional electromagnetic locking mechanism, according to an embodiment of the present invention, as viewed from the inside of the door.
Figure 7:
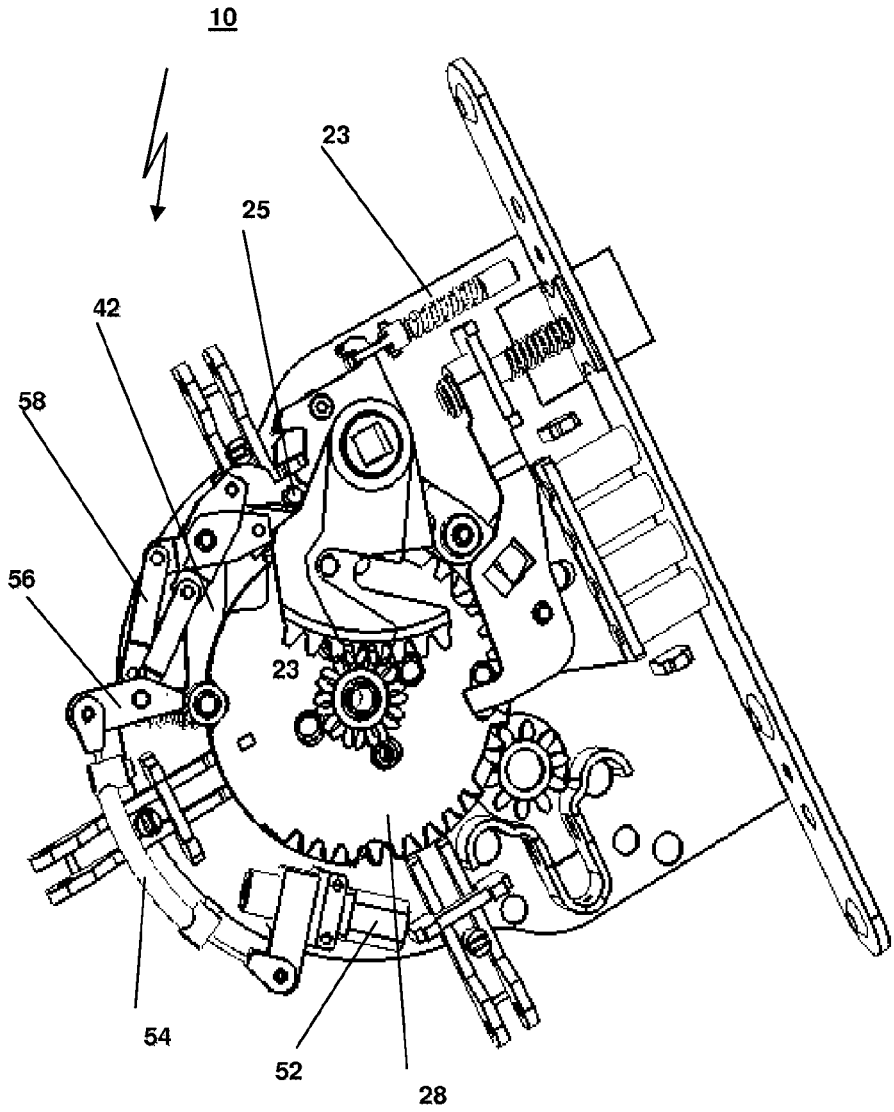
FIG. 7 is a perspective view of the lock mechanism shown in FIG. 6 as viewed from the outside of the door.

FIG. 6 is a perspective view of a lock mechanism provided with an additional electromagnetic catch mechanism, according to an embodiment of the present invention, as viewed from the inside of the door. FIG. 7 is a perspective view of the lock mechanism shown in FIG. 6 as viewed from the outside of the door. Electromagnetic actuator 52 is remotely controlled. In response to remote activation, actuator 52 pushes or pulls cable 54. Pushing or pulling cable 54 moves catch 56. When the electronic locking mechanism is locked, catch 56 presses on spring-loaded arm 42 and holds it in notch 46*a*. Holding spring-loaded arm 42 in notch 46*a* prevents motion operating wheel 28 so that the lock may not be opened with a key. When the electronic locking mechanism is unlocked, catch 56 does not hold spring-loaded arm 42 in notch 46*a*. Operating wheel 28 is then free to rotate and the lock may be opened with a key. However, rotating inner door handle 18 (shown in FIG. 1) causes pin-release mechanism 58 to cause catch 56 to release spring-loaded arm 42. The bolt-release and latch release mechanisms described above are then free to unlock and unlatch the door, allowing the door to open. Thus, when turning inner door handle 18 releases the electromagnetically actuated locking mechanism, the bolt mechanism and the latch mechanism.

In embodiments of the present invention described above, during operation of the emergency unlocking mechanism, inner door handle 18 (shown in FIG. 1) and gear arm 22 rotate together in one direction. Gear arm 22 engages auxiliary gear wheel 48, causing auxiliary gear wheel 48 and operating wheel 28 to rotate together in the opposite direction. In other embodiments of the present invention, the operating wheel is designed to rotate in the same direction as the inner door handle during operation of the emergency unlocking mechanism.

Figure 9A:
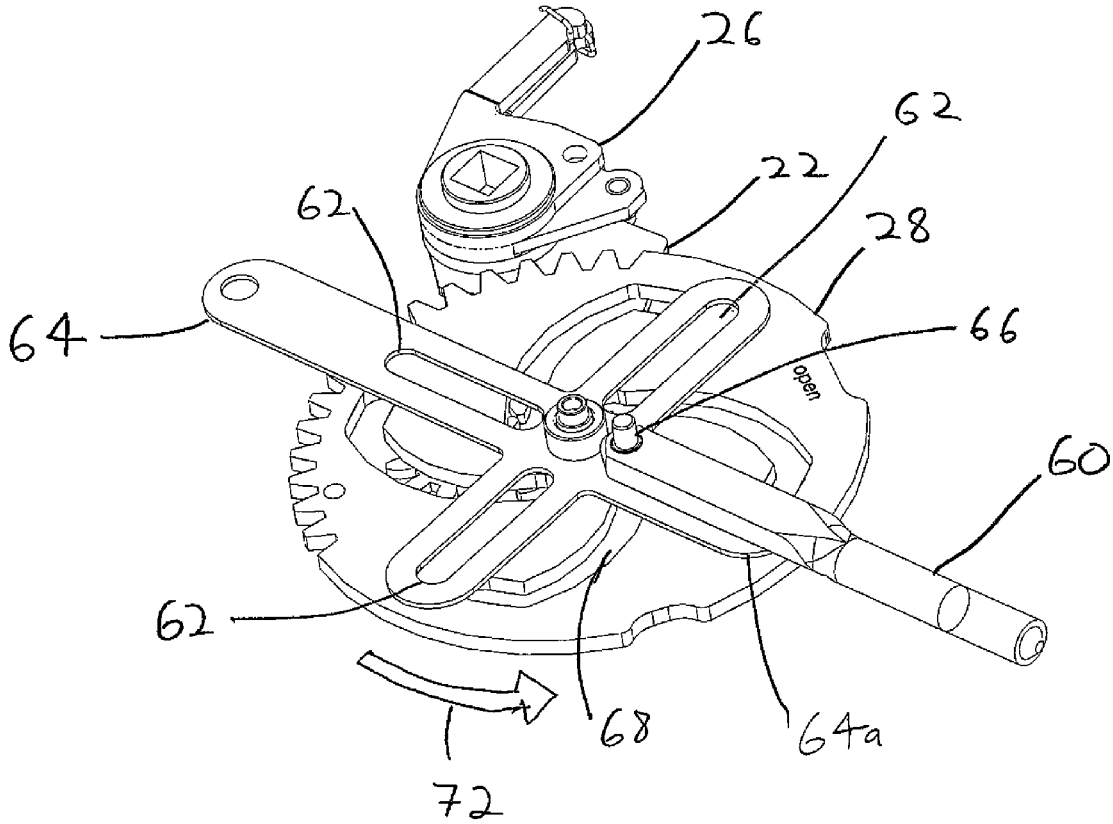
FIG. 9A is a perspective view of components of an alternative lock mechanism with emergency unlocking capability, in accordance with some embodiments of the present invention.
Figure 9B:
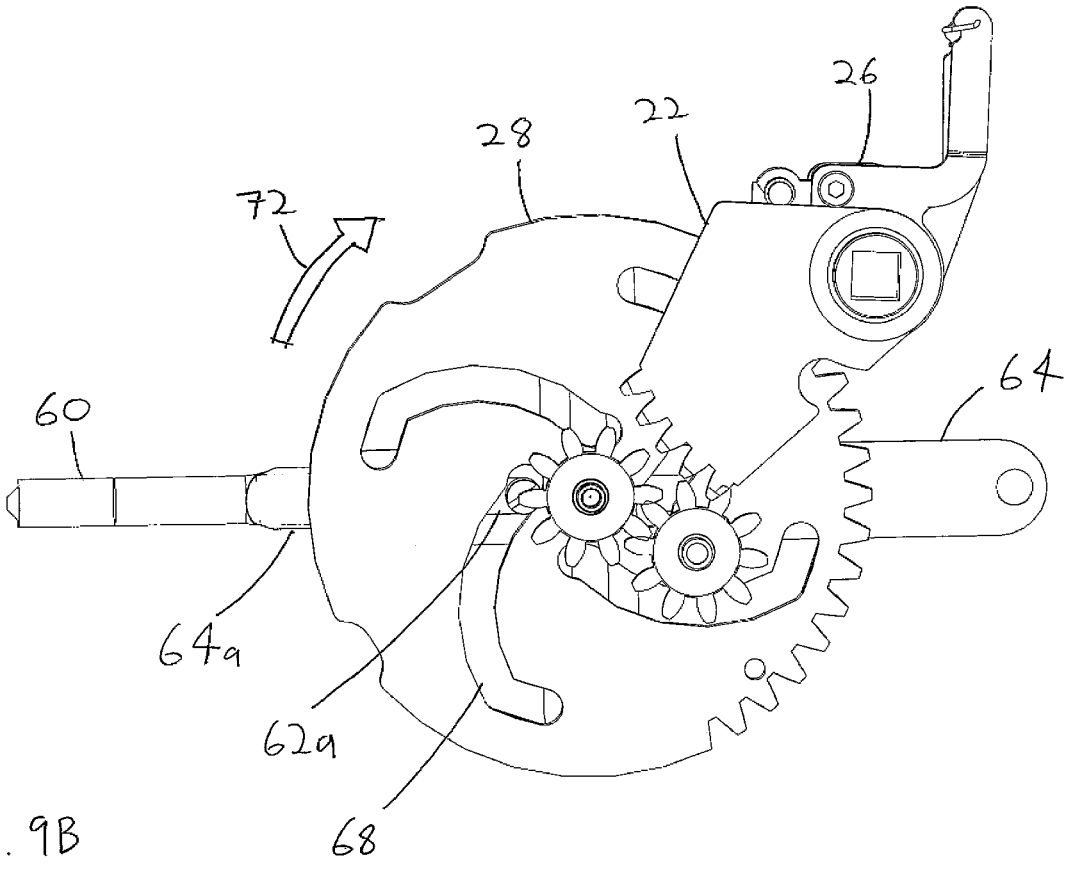
FIG. 9B shows a side view of the opposite side of the alternate lock mechanism shown in FIG. 9A.

FIG. 9A is a perspective view of components of an alternative lock mechanism with emergency unlocking capability, in accordance with some embodiments of the present invention. FIG. 9B shows a side view of the opposite side of the alternate lock mechanism shown in FIG. 9A. The lock mechanism shown in FIG. 9 is similar to that of lock model 104/105 produced by Shiryonit Hosen Ltd. Rotation of operating wheel 28 causes extension or retraction of one or more rods, such as rod 60. Screw 66 is attached to the proximal end of rod 60. Screw 66 extends through, and is confined by, slot 62*a* in arm 64*a* of slot plate 64. Slot in arm 64*a*, only partially visible, is shaped similarly to one of slots 62. Screw 66 also extends through and is confined by curved slot 68 in operating wheel 28. Therefore, when operating wheel 28 is rotated in the direction indicated by arrow 72, the curved shape of curved slot 68 causes screw 66 to travel outward along slot 62*a*. The outward travel of screw 66 extends rod 60. Conversely, rotation of operating wheel in the direction opposite the direction indicated by arrow 72 retracts rod 60.

Figure 10:
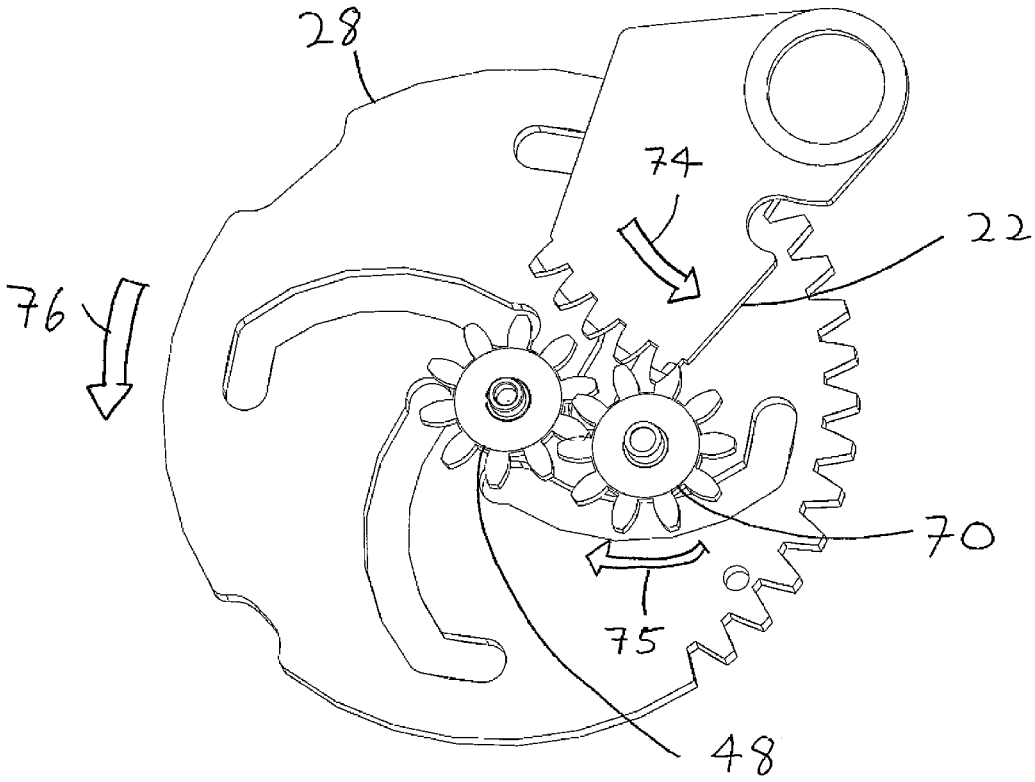
FIG. 10 is a perspective view of components of the emergency unlocking mechanism of the alternate lock mechanism shown in FIG. 9B.

FIG. 10 is a perspective view of components of the emergency unlocking mechanism of the alternate lock mechanism shown in FIG. 9B. When turning the inner handle in order to operate the emergency unlocking mechanism, gear arm 22 rotates in the direction indicated by arrow 74. Operation of the emergency unlocking mechanism retracts any extended rods or bolts by rotating operating wheel 28 in the direction indicated by arrow 76 (opposite the direction of arrow 72 shown in FIG. 9B). Since arrows 74 and 76 indicate the same direction of rotation, intermediary gear wheel 70 is provided. Intermediary gear wheel 70 engages gear arm 22 and auxiliary gear wheel 48. When gear arm 22 is rotated in the direction indicated by arrow 74, gear arm 22 turns gear wheel 70 in the direction indicated by arrow 75. Intermediary gear wheel 70 turns auxiliary gear wheel 48 and operating wheel 28, which is attached to auxiliary gear wheel 48, in the direction indicated by arrow 76. Rotation of operating wheel in the direction indicated by arrow 76 retracts any extended rods or bolts, enabling opening of a door provided with the emergency unlocking mechanism.

Thus, when a door is provided with a lock that is an embodiment of the present invention, a person who is capable of turning the door handle will be able to unlock and open the door in an emergency situation.

It should be clear that the description of the embodiments and attached Figures set forth in this specification serves only for a better understanding of the invention, without limiting its scope.

It should also be clear that a person skilled in the art, after reading the present specification could make adjustments or amendments to the attached Figures and above described embodiments that would still be covered by the present invention.

The invention claimed is:

1. A door locking device for a door cooperating with a door frame, comprising:

a plurality of elongated bolts adapted to move linearly to engage and disengage the door frame;

a latch mechanism for engaging with the door frame, the latch mechanism including a latch member and a latch arm;

an operating wheel for translating circular motion to a linear motion of each of the elongated bolts, the operating wheel further including a member adapted to engage the latch arm; and an unlocking mechanism including a gear arm and a lock nut mechanism connected to a handle;

wherein, operation of only the handle is adapted to turn the lock nut mechanism, turning the gear arm to turn the operating wheel in order to disengage the plurality of bolts from the door frame and to rotate the latch arm and disengage the latch member from the door frame.

2. The device of claim 1, wherein the unlocking mechanism further includes an auxiliary gear wheel affixed to the operating wheel and wherein the gear arm is adapted to rotate the operating wheel by engaging teeth of the auxiliary gear wheel.

3. The device of claim 2, wherein the auxiliary gear wheel is affixed coaxially to the operating wheel.

4. The device of claim 2, further comprising a separately actuated catch mechanism used to immobilize the operating wheel by pressing on a spring-loaded arm which engages a notch in the operating wheel, the catch mechanism released when the handle is turned.

5. The device of claim 4, wherein the catch mechanism includes an electromagnetic actuator.

6. The device of claim 5, wherein the catch mechanism is remotely controlled.

7. The device of claim 2, wherein the operation of the handle includes partially turning the handle to first disengage the latch member from the door frame and then further turning the handle to disengage the plurality of bolts from the door frame.

8. The device of claim 1, further comprising another handle for operating only the latch.

9. The device of claim 1, wherein the operating wheel is adapted to rotate in the same direction as a rotation direction of the gear arm.

10. The device of claim 1, further comprising a separately actuated catch mechanism used to immobilize the operating wheel by pressing on a spring-loaded arm which engages a notch in the operating wheel, the catch mechanism released when the handle is turned.

11. The device of claim 10, wherein the catch mechanism includes an electromagnetic actuator.

12. The device of claim 11, wherein the catch mechanism is remotely controlled.

13. The device of claim 1, wherein the handle is an inner door handle.

14. The device of claim 1, wherein the handle is a knob.

15. The device of claim 1, wherein the plurality of bolts includes 4-way bolts.

16. The device of claim 15, wherein the plurality of bolts includes seven bolts.

17. A method for unlocking a door set in a door frame, the door including a plurality of elongated bolts adapted to move linearly to engage and disengage the door frame, a latch mechanism for engaging with the door frame and including a latch member and a latch arm, and an operating wheel for translating circular motion to a linear motion of each of the elongated bolts, the operating wheel further including a member adapted to engage the latch arm, the method comprising steps of:

providing an unlocking mechanism including a gear arm and a lock nut mechanism connected to a handle; and using only the handle to turn the lock nut mechanism to turn the gear arm to rotate the operating wheel in order to disengage the plurality of bolts from the door frame and to rotate the latch arm and disengage the latch member from the door frame.

18. The method of claim 17, wherein the plurality of bolts includes 4-way bolts.

19. The method of claim 18, wherein the 4-way bolts include seven bolts.

20. The method of claim 17, wherein the step of using only the handle includes first turning the handle partially to disengage the latch member from the door frame and then further turning the handle to disengage the plurality of bolts from the door frame.

* * * * *